United States Patent [19]

Chaussadas

[11] Patent Number: 4,596,356

[45] Date of Patent: Jun. 24, 1986

[54] MULTIPACK FOR CONTAINERS

[75] Inventor: Jean Chaussadas, Brassioux, Deols, France

[73] Assignee: The Mead Corporation, Dayton, Ohio

[21] Appl. No.: 749,351

[22] Filed: Jun. 27, 1985

[30] Foreign Application Priority Data

Jun. 28, 1984 [GB] United Kingdom ..... 8416542

[51] Int. Cl.[4] ..... B65D 5/48

[52] U.S. Cl. ..... 229/40; 206/194; 229/29 C

[58] Field of Search ..... 229/27, 28 R, 29 R, 229/29 B, 29 C, 29 D, 29 F, 40; 206/427, 434, 193–198

[56] References Cited

U.S. PATENT DOCUMENTS

| | | | |
|---|---|---|---|
| 2,401,158 | 5/1946 | Holy | 206/194 |
| 2,812,105 | 11/1957 | Parker | 206/193 |
| 3,283,990 | 11/1966 | Tolaas | 229/40 |
| 3,498,449 | 3/1970 | Spery | 229/40 |
| 3,598,302 | 8/1971 | Nowak | 229/40 |
| 3,780,906 | 12/1973 | Katzenmeyer | 206/194 |
| 4,164,286 | 8/1979 | Sutherland | 229/40 |
| 4,448,308 | 5/1984 | Carver | 229/40 |
| 4,489,880 | 12/1984 | Calvert | 229/29 R |

FOREIGN PATENT DOCUMENTS

| | | | |
|---|---|---|---|
| 253833 | 8/1964 | Australia | 229/28 R |

*Primary Examiner*—William Price
*Assistant Examiner*—Gary E. Elkins
*Attorney, Agent, or Firm*—Erwin Doerr

[57] ABSTRACT

A carton (Cn) accommodating two rows ($R^1$, $R^2$) of uniform containers (C) comprising a top panel (12) overlying the tops of the containers and a base panel (16,18,20,22) interconnected by spaced side wall panels (14,24) to form a tubular structure. The base panel includes a pair of outer base panels (16,22) adjacent respective ones of the side wall panels and on which base portions of the containers are seated and a pair of inner base panels (18,20) dislodged upwardly between two adjacent rows of containers to form a keel (72) therebetween. Each inner base panel is formed with apertures (54,56,58 and 60,62,64) which receive and locate lower portions of the containers so that they are held spaced relative to one another. A plurality of partition panels (66,68,70) extend from the keel separating adjacent containers in one row from those in the neighboring row, the partition panels being connected to the top panel thereby maintaining the structural rigidity of the keel.

5 Claims, 9 Drawing Figures

MULTIPACK FOR CONTAINERS

This invention relates to a carton accommodating a plurality of rows of containers particularly frusto-conical containers having a peripheral top flange such as cups containing yoghurt or other food product.

One aspect of the invention provides a carton accommodating a plurality of parallel rows of uniform containers which carton comprises a single blank of foldable sheet material and comprising a top panel overlying the tops of the containers and a base panel, interconnected by spaced side wall panels to form a tubular structure and wherein the base panel comprises a pair of outer base panels adjacent respective ones of the side wall panels and on which base portions of the containers are seated and a pair of inner base panels dislodged upwardly between two adjacent rows of containers to form a keel therebetween, each inner base panel being formed with apertures which receive and locate lower portions of the containers so that they are held spaced relative to one another, and wherein a plurality of partition panels extend from the keel separating adjacent containers in one row from those in the neighbouring row, the partition panels being connected to the top panel thereby maintaining the structural rigidity of the keel.

According to a feature of this aspect of the invention, the partition panels may be provided by material struck from one of the inner base panels to form one row of said container.

According to another feature of this aspect of the invention a connecting tab may be hinged to each partition panel and is connected to the undersurface of the top panel. The connecting tab may be struck from an outer base panel adjacent said one inner base panel.

An embodiment of the invention will now be described, by way of example, with reference to the accompanying drawings, in which.

Figure 4:
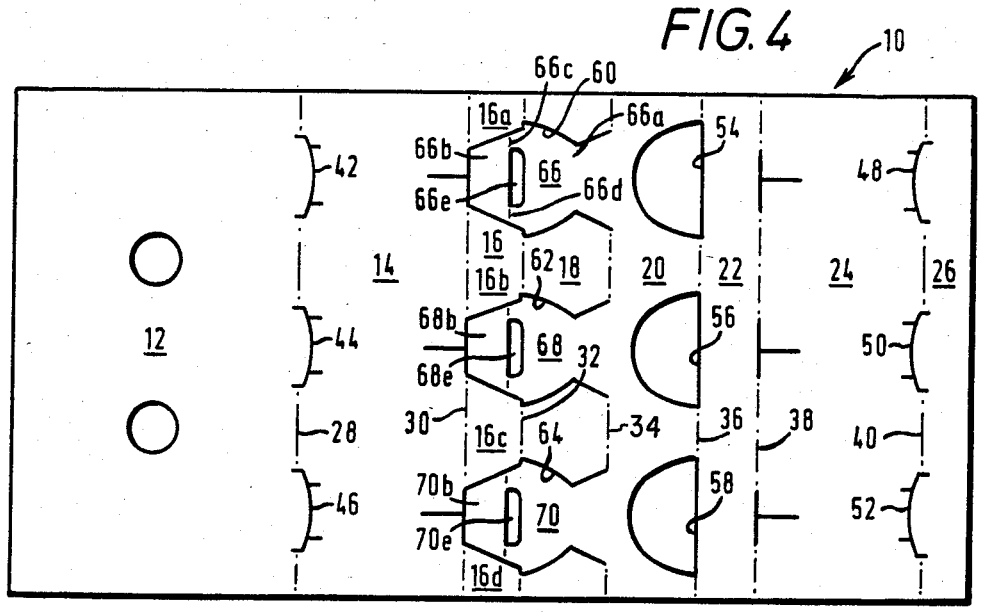
FIG. 4 is a plan view of a blank from which the carton is formed.

Referring to the drawings, the carton '$C_n$' is formed from an elongate blank (10) of paperboard or similar foldable sheet material and is shown in FIG. 4. The blank comprises, in series, a main top panel 12; a first side wall panel 14; a centre section generally forming the base area of the carton which includes a first outer base panel 16; a first inner base panel 18; a second inner base panel 20; and a second outer base panel 22; the blank further including a second side wall panel 24 and a subsidiary top panel 26. The panels are hinged one to the next along transverse fold lines 28–40. A series of three generally arcuate slits 42, 44 and 46 is struck from the blank at spaced locations along fold line 28 and similar slits 48, 50 and 52 are formed along fold line 40. The slits of both series are sized to receive peripheral portions of top flanges of containers accommodated in the carton and contribute in locating upper portions of the containers in their correct positions within the carton as will be apparent.

The centre section of the blank also has apertures struck therefrom in order to receive base portions of the containers for correct location. To this end a row of three semicircular apertures 54, 56 and 58 is struck from the second inner base panel, and a further row of three apertures 60, 62 and 64 is struck partially from the first outer base panel 16 and partially from the first inner base panel 18.

Whereas the material struck from the blank in forming apertures 54, 56 and 58 is completely discarded, the material struck from the blank in forming apertures 60, 62 and 64 is retained in order to form three central partition panels 66, 68 and 70, each of which is connected to the blank along transverse fold line 34 thereby interrupting that fold line. Since the basic elements of each central partition panel are essentially identical, only panel 66 will be described in detail.

Central partition panel 66 comprises an upstanding portion **66*a* which is struck mainly from the first inner base panel 18 to form a partition element, which separates two parallel rows $R^1$ and $R^2$ of containers within the carton, and a connecting tab 66*b* which is secured to the inner face of top panel 12 as described later. Thus, the connecting tabs of the central partition panels interrupt both the transverse fold line 32 and the first outer base panel 16 thereby forming panel portions 16*a*, 16*b*, 16*c* and 16*d*. The connecting tab 66*b* is hinged to the upstanding portion 66*a* by two short fold lines 66*c* and 66*d* respectively. The fold lines 66*c* and 66*d* are spaced apart by aperture 66*e* struck from the partition panel and which is sized to receive a peripheral portion of a container top flange which is diametrically opposed to the flange portions received in arcuate slit 48**.

Figure 1:
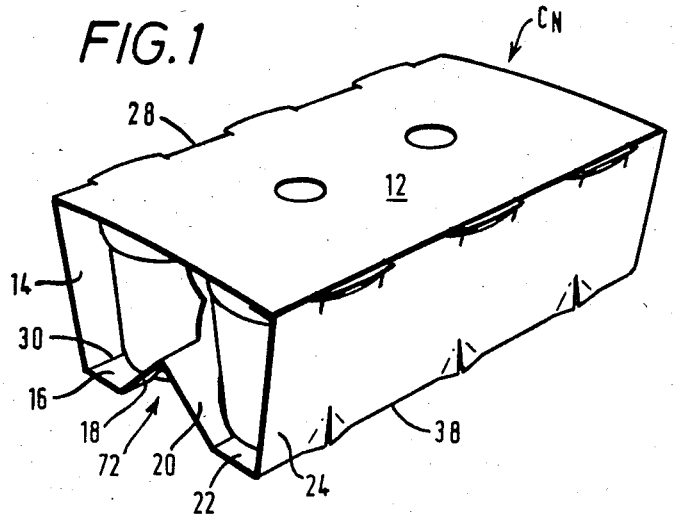
FIG. 1 is a perspective view of a carton according to the invention, as seen from one end thereof.
Figure 2:
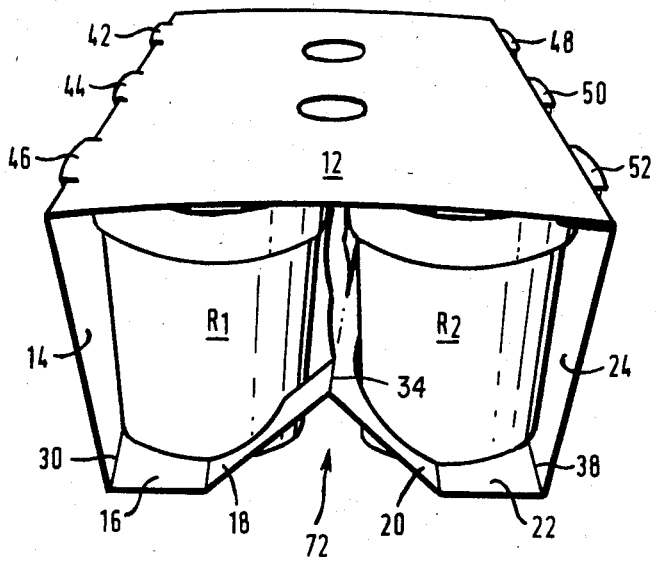
FIG. 2 is a perspective end view of the carton shown in FIG. 1.
Figure 3:
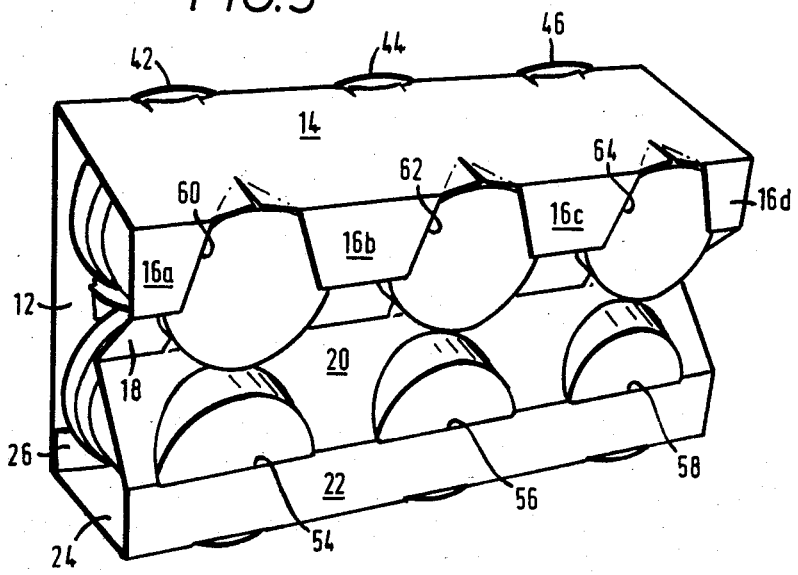
FIG. 3 is a perspective view of the carton base.
Figure 5:
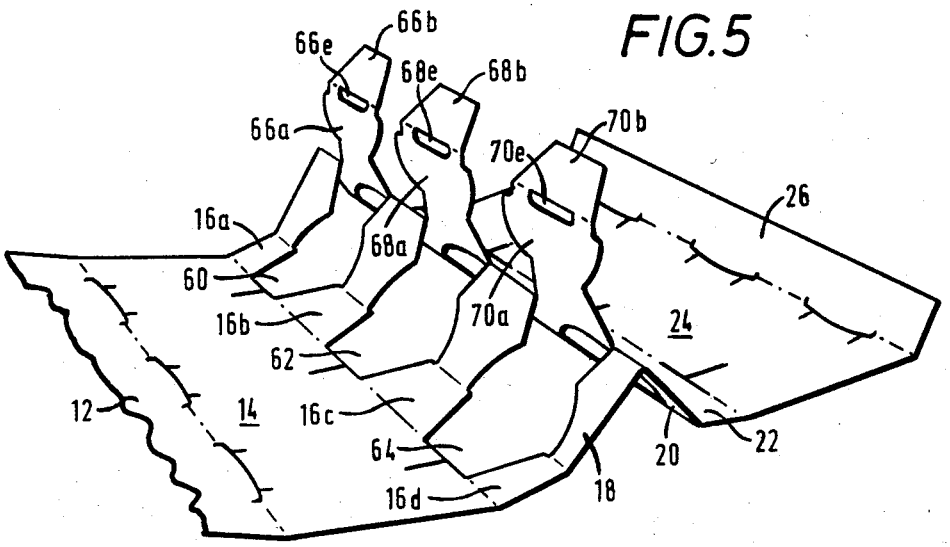
FIG. 5 is a perspective view of the carton blank in which mid-section parts of the blank are shown displaced out of the plane of the blank.

In order to form the completed carton as shown in FIGS. 1 to 3, first the centre section of the blank is displaced out of the plane of the blank. More specifically, and as shown in FIG. 5, the two inner base panels 18 and 20 are raised by folding about fold lines 32, 34 and 36 so that those panels are inclined to form a central keel 72. The apex of the keel is formed by interrupted fold line 34 and the included angle between the inclined panels 18 and 20 is approximately 60°. The central partition panels 66, 68 and 70 are also displaced from the plane of the blank into an upstanding position, and thereby provide a central partition for separating the rows of containers in the carton.

Figure 6:
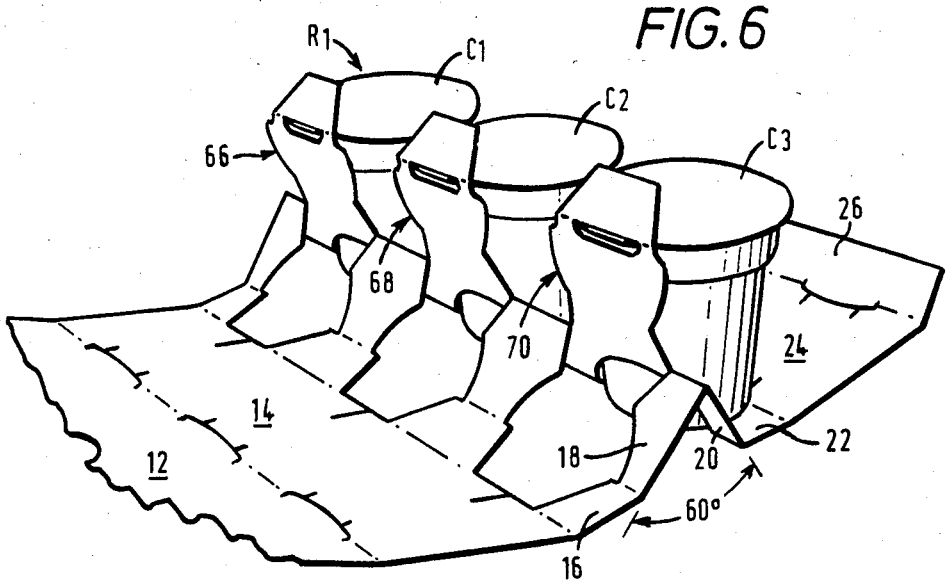
FIG. 6 is a view similar to FIG. 5 but showing a first row of containers located in their relative positions on the carton blank.

A first row $R^1$ of containers $C^1$, $C_2$ and $C_3$ is then introduced onto the blank so that their bases are partially seated on outer base panel 22. Each container has a base portion thereof located in respective ones of the locating apertures 54, 56 and 58, as shown in FIG. 6.

Figure 7:
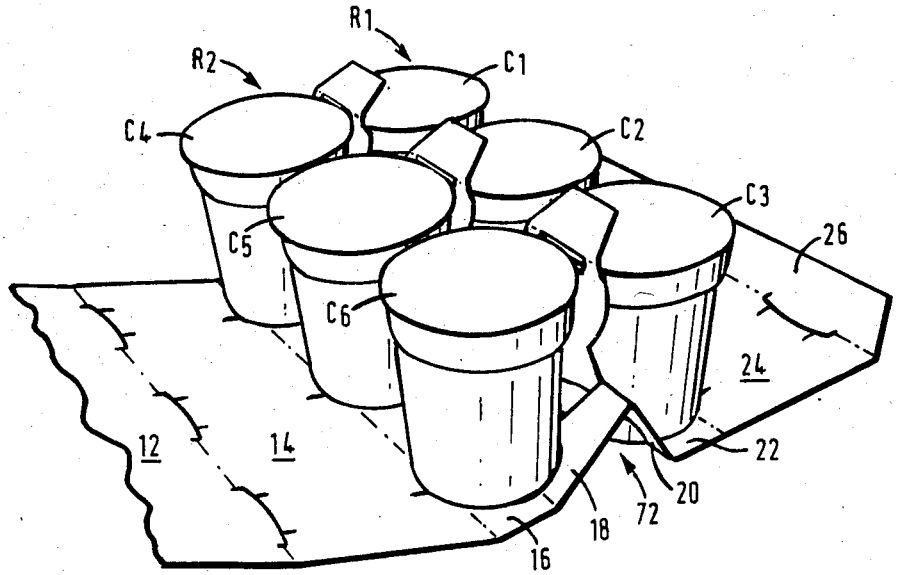
FIG. 7 is a view similar to FIG. 6 but showing a first and second row of containers located in their relative positions on the carton blank.
Figure 8:
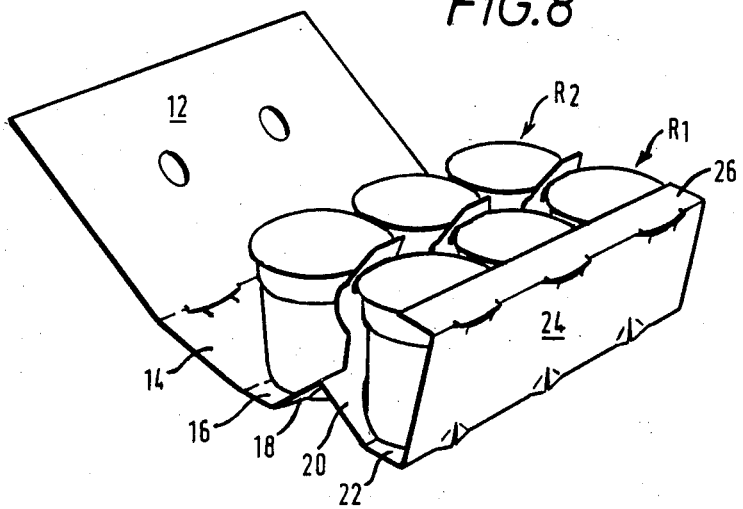
FIG. 8 is a perspective view similar to FIG. 7 but in which the carton blank is shown partially wrapped about the two rows of containers.

Referring now to FIG. 7, a second row $R^2$ of containers $C^4$ $C^5$ and $C^6$ is also introduced onto the blank (which preferably is effected simultaneously with introduction of the row $R^1$ containers) so that their bases are partially seated on outer base panel portions **16*a*, 16*b*, 16*c* and 16*d*. Each container has a base portion thereof located in respective ones of the locating apertures 60, 62 and 64**.

Thereafter, the blank is further manipulated to bring side wall 24 into an upstanding position by folding about transverse fold line 38 (FIG. 7) whereby side wall 24 flanks body portions of the containers in row $R^1$. Also, the subsidiary top panel is folded about fold line 40 into flat superposed relationship with respect to the tops of the containers in row $R^1$. In so doing, the adjacent peripheral portions of the top flanges of containers $C^1$,$C^2$ and $C^3$ are located in location slits 48, 50 and 52, respectively.

Similarly, the connecting tabs 66*b*, 68*b* and 70*b* of the central portion panels 66, 68 and 70 are folded into flat superposed relationship with respect to the tops of the containers in row $R^1$. In so doing, the peripheral portions of the top flanges of containers $C^1$, $C^2$ and $C^3$ which are diametrically opposite the flange portions located in slits 48, 50 and 52 are received in location apertures 66*e*, 68*e* and 70*e*. These location apertures also receive peripheral portions of the top flanges of containers C4, C5 and C6 in row $R^2$.

Figure 9:
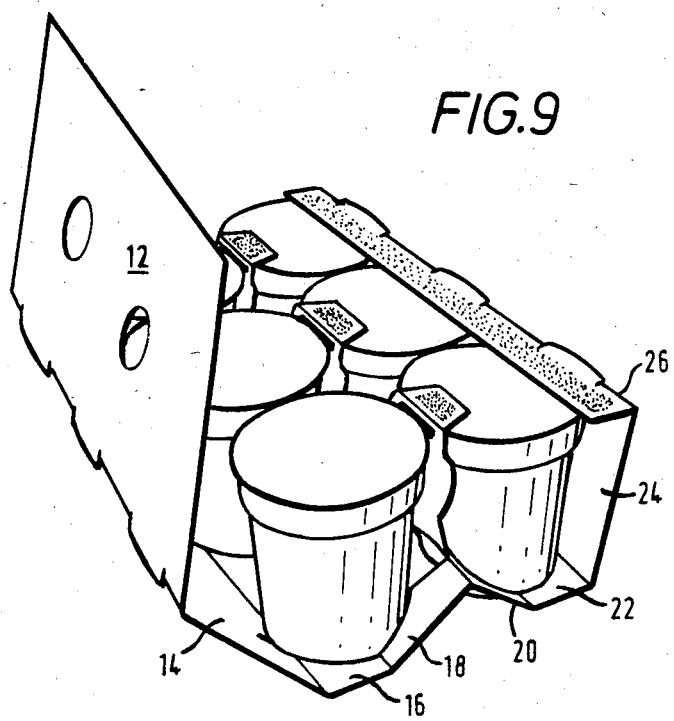
FIG. 9 is a perspective view of the partially formed carton showing the zones to which glue is applied.

An application of glue is then made to the upward facing surfaces of each of the connecting tabs and along the upward facing surface of the subsidiary top panel as shown in FIG. 9.

Side wall panel 14 is brought into upstanding position by folding about transvese fold line 30 and top panel 12 is folded about transverse fold line 28 and brought into flat superposed relationship with respect to the tops of both rows of containers. In so doing, the adjacent peripheral portions of the top flanges of containers C4, C5 and C6 are located in location slits 42, 44 and 46 and the undersurface of the top panel is adhered to the connecting tabs 66*b*, 68*b* and 70*b* and to the subsidiary top panel 26 in order to complete the package.

It is envisaged that the carton may be modified to accommodate more than two rows of containers separated by a similar keel construction.

I claim:

1. A carton accommodating a plurality of parallel rows of uniform containers which carton comprises a single blank of foldable sheet material having a top panel (12,26) overlying the tops of the containers (C) and a base panel (16,18,20,22) interconnected by spaced side wall panels (14,24) to form a tubular structure, said base panel comprising a pair of outer base panels (16,22) adjacent respective ones of the side wall panels and on which base portions of the containers are seated and a pair of inner base panels (18,20) dislodged upwardly between two adjacent rows ($R^1$,$R^2$) of containers to form a keel (72) therebetween, each inner base panel being formed with apertures (54,56,58:60,62,64) which receive and locate lower portions of the containers so that they are held spaced relative to one another, and a plurality of partition panels (66,68,70) extending from the keel separating adjacent containers in one row from those in the neighboring row and being connected to the top panel, characterized in that each of said partition panels is formed by material struck partially from one (18) of said inner base panels and partially from one (16) of said outer base panels adjacent said one inner base panel.

2. A carton according to claim 1, further characterized in that said inner base panels are inclined relative to one another and hinged together by a fold line (34) to form an apex of said keel, and in that said fold line is interrupted by said partition panels.

3. A carton according to claim 2, further characterised in that each partition panel comprises a portion (66*a*) upstanding from the apex of said keel struck mainly from said one inner base panel and a connecting tab (66*b*) hinged to said upstanding portion and secured to the innermost face of said top panel in superposed relationship with respect to one row of containers.

4. A carton according to claim 3, further characterised in that an aperture (66*e*) is formed along the hinged connection (66*c*, 66*d*) between said upstanding portion and said connecting tab of each partition panel, which aperture receives a peripheral portion of a container top flange.

5. A carton blank comprising, in series, a main top panel (12), a first side wall panel (14), a centre section for forming the base area of the carton and a second side wall panel and a subsidiary top panel, hinged one to the next, characterised in that said centre section comprises a first outer base panel 16, a first inner base panel (18), a second inner base panel (20) and a second outer base panel (22) hinged one to the next and in that a series of partition panels are struck partially from said first outer base panel and partially from said first inner base panel and foldable into an upstanding position about the hinged connection (34) between said inner base panels.

* * * * *